US011634785B2

(12) United States Patent
Kim

(10) Patent No.: US 11,634,785 B2
(45) Date of Patent: Apr. 25, 2023

(54) STEEL MATERIAL SHOWING EXCELLENT HYDROGEN-INDUCED CRACKING RESISTANCE AND METHOD FOR PREPARING SAME

(71) Applicant: POSCO, Pohang-si (KR)

(72) Inventor: Dae-Woo Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 185 days.

(21) Appl. No.: 16/957,836

(22) PCT Filed: Dec. 24, 2018

(86) PCT No.: PCT/KR2018/016562
§ 371 (c)(1),
(2) Date: Jun. 25, 2020

(87) PCT Pub. No.: WO2019/132465
PCT Pub. Date: Jul. 4, 2019

(65) Prior Publication Data

US 2021/0062285 A1 Mar. 4, 2021

(30) Foreign Application Priority Data

Dec. 26, 2017 (KR) ..... 10-2017-0179340

(51) Int. Cl.

| | |
|---|---|
| ***C21D 9/46*** | (2006.01) |
| ***C21D 6/00*** | (2006.01) |
| ***C22C 38/00*** | (2006.01) |
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/58*** | (2006.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C22C 38/50* (2013.01); *C22C 38/58* (2013.01); *C21D 2211/001* (2013.01)

(58) Field of Classification Search

CPC ..... C21D 9/46; C21D 6/004; C21D 6/005; C21D 6/008; C21D 8/0205; C21D 8/0226; C21D 8/0263; C21D 2211/001; C21D 1/28; C21D 6/00; C21D 6/02; C21D 8/02; C21D 2211/005; C22C 38/002; C22C 38/02; C22C 38/04; C22C 38/06; C22C 38/42; C22C 38/44; C22C 38/48; C22C 38/50; C22C 38/58; C22C 38/00; C22C 38/46; C22C 38/08; C22C 38/12; C22C 38/16

See application file for complete search history.

(56) References Cited

U.S. PATENT DOCUMENTS

| | | | |
|---|---|---|---|
| 2014/0144551 | A1 | 5/2014 | Minato et al. |
| 2016/0230258 | A1 | 8/2016 | De |
| 2016/0333447 | A9 | 11/2016 | De |
| 2019/0024206 | A1 | 1/2019 | Kim |

FOREIGN PATENT DOCUMENTS

| | | | | |
|---|---|---|---|---|
| CN | 101481780 | A | 7/2009 | |
| CN | 103189538 | A | 7/2013 | |
| EP | 2520680 | A2 | 11/2012 | |
| JP | H04-329826 | A | 11/1992 | |
| JP | H05-287441 | A | 11/1993 | |
| JP | 2003-013175 | A | 1/2003 | |
| JP | 2012-082525 | A | 4/2012 | |
| JP | 2014-005534 | A | 1/2014 | |
| JP | 2014-189808 | A | 10/2014 | |
| JP | 2016-089187 | A | 5/2016 | |
| JP | 2016-089188 | A | 5/2016 | |
| JP | 2017-048443 | A | 3/2017 | |
| KR | 10-0833071 | B1 | 5/2008 | |
| KR | 10-2010-0076727 | A | 7/2010 | |
| KR | 20100110247 | A * | 10/2010 | ..... B21B 1/38 |

(Continued)

OTHER PUBLICATIONS

International Search Report issued in corresponding International Patent Application No. PCT/KR2018/016562 dated Apr. 4, 2019.

(Continued)

*Primary Examiner* — Anthony M Liang
*Assistant Examiner* — Danny N Kang
(74) *Attorney, Agent, or Firm* — Morgan, Lewis & Bockius LLP

(57) ABSTRACT

A steel material showing excellent hydrogen-induced cracking resistance according to an aspect of the present invention comprises, in weight %, 0.10-0.25% of C, 0.05-0.50% of Si, 1.0-2.0% of Mn, 0.005-0.1% of Al, 0.010% or less of P, 0.0015% or less of S, 0.001-0.03% of Nb, 0.001-0.03% of V, 0.01-0.15% of Mo, 0.01-0.50% of Cu, 0.05-0.50% of Ni, and the remainder being Fe and unavoidable impurities, and has a thickness of 100-300 mm. The maximum size of pores formed inside can be 1 μm or less.

4 Claims, No Drawings

(56) References Cited

FOREIGN PATENT DOCUMENTS

| | | | | |
|---|---|---|---|---|
| KR | 10-2011-0060449 | A | 6/2011 | |
| KR | 10-2012-0074638 | A | 7/2012 | |
| KR | 101253890 | B1 * | 4/2013 | ..... C21D 1/28 |
| KR | 10-2013-0076570 | A | 7/2013 | |
| KR | 10-1359068 | B1 | 2/2014 | |
| KR | 10-2014-0056760 | A | 5/2014 | |
| KR | 10-1736638 | B1 | 5/2017 | |
| WO | 2017/111416 | A1 | 6/2017 | |

OTHER PUBLICATIONS

Extended European Search Report dated Jan. 28, 2021 issued in European Patent Application No. 18894009.2.
Chinese Office Action dated Apr. 1, 2021 issued in Chinese Patent Application No. 201880084248.7 (with English translation).
Japanese Office Action dated Sep. 28, 2021 issued in Japanese Patent Application No. 2020-535202.

* cited by examiner

STEEL MATERIAL SHOWING EXCELLENT HYDROGEN-INDUCED CRACKING RESISTANCE AND METHOD FOR PREPARING SAME

CROSS-REFERENCE OF RELATED APPLICATIONS

This application is the U.S. National Phase under 35 U.S.C. § 371 of International Patent Application No. PCT/KR2018/016562, filed on Dec. 24, 2018, which in turn claims the benefit of Korean Application No. 10-2017-0179340, filed on Dec. 26, 2017, the entire disclosures of which applications are incorporated by reference herein.

TECHNICAL FIELD

The present disclosure relates to a steel material for a pressure container and a method for manufacturing the same, and more particularly, to a steel material for a pressure container, effectively securing hydrogen-induced cracking (HIC) resistance, and a method for manufacturing the same.

BACKGROUND ART

A steel material for a pressure vessel, used in petrochemical production equipment, storage tanks, and the like, has continued to be increased in size and thickened with an increase in use time. To secure structural stability of a base material and a welding zone when such a steel material is applied to large-scale structures, a carbon equivalent Ceq tends to be reduced and impurities tend to be controlled to limits. Moreover, as production of crude oil containing a large amount of $H_2S$ is increased, the standards for resistance characteristics to hydrogen-induced cracking (HIC) are becoming stricter.

The principle of the occurrence of hydrogen-induced cracking (HIC) in a steel material will now be described. Corrosion occurs as a surface of the steel material is brought into contact with a wet hydrogen sulfide contained in crude oil. Hydrogen atoms, generated by the corrosion of the steel material, permeate and diffuse into the steel material to be present in an atomic state in the steel material. The hydrogen atoms, penetrating and diffusing into the steel material, are molecularized in the form of a hydrogen gas to generate gas pressure. Due to the gas pressure, brittle cracking occurs in vulnerable structures (for example, an inclusion, a segregation zone, an internal pore, and the like) in the steel material. Such cracking gradually grows with the lapse of use time, constant application of a load, or the like. Ultimately, the grown cracking causes fracturing of the steel material.

Various technologies have been developed to improve hydrogen-inducted cracking resistance of a steel material used under a hydrogen sulfide atmosphere. Among the various technologies, representative technologies may include (1) a method of adding elements such as copper (Cu), or the like, (2) a method for significantly reducing a hard structure in which cracking easily occurs or propagates (for example, pearlite, or the like) or controlling a shape of the hard structure, (3) a method for improving resistance to occurrence of cracking by controlling a matrix structure with a hard structure such as tempered martensite, tempered bainite, or the like, through a water treatment such as normalizing and accelerated cooling and tempering (NACT), quenching and tempering (QT), direct quenching and tempering (DQT), or the like, (4) a method for controlling an internal defect of an inclusion, or the like, in a steel material which may act as a cracking initiation point, and the like.

However, such technologies are limited in application to a thick steel sheet. In particular, when such technologies are applied to a steel material having a thickness of 100 to 300 mm and tensile strength of 500 MPa, sufficient hydrogen-induced cracking resistance characteristics are not secured.

(Patent Document 1) Japanese Patent Laid-Open Publication No. 2003-013175 (published Jan. 15, 2003)

DISCLOSURE

Technical Problem

An aspect of the present disclosure is to provide a steel material having excellent hydrogen-inducted cracking resistance and a method for preparing the same.

On the other hand, the objective of the present disclosure is not limited to the above description. The objective of the present disclosure maybe understood from the content of the present specification. Those skilled in the art will have no difficulty in understanding additional objectives of the present disclosure.

Technical Solution

According to an aspect of the present disclosure, a steel material having excellent hydrogen-induced cracking resistance includes, by weight percentage (wt %): 0.10 to 0.25% of carbon (C), 0.05 to 0.50% of silicon (Si), 1.0 to 2.0% of manganese (Mn), 0.005 to 0.1% of aluminum (Al), 0.010% or less of phosphorus (P), 0.0015% or less of sulfur (S), 0.001 to 0.03% of niobium (Nb), 0.001 to 0.03% of vanadium (V), 0.01 to 0.15% of molybdenum (Mo), 0.01 to 0.50% of copper (Cu), 0.05 to 0.50% of nickel (Ni), and a remainder of iron (Fe) and unavoidable impurities. The steel material has a thickness of 100 to 300 mm. A maximum size of a pore, formed in the steel material, is 1 μm or less.

The steel material may have a ferrite structure of 70 area % and a retained pearlite structure as a microstructure.

The steel material may further include, by wt %: one or two or more of 0.001 to 0.03% of titanium (Ti), 0.01 to 0.20% of chromium (Cr), and 0.0005 to 0.004% of calcium (Ca).

The steel material may have tensile strength of 500 MPa or more, Charpy impact absorption energy of 250 J or more at a temperature of −46° C., and a hydrogen-induced cracking length ratio of 5% or less.

According to another aspect of the present disclosure, a method for manufacturing a steel material having excellent hydrogen-induced cracking resistance includes primarily heating a slab including, by weight percentage (wt %), 0.10 to 0.25% of carbon (C), 0.05 to 0.50% of silicon (Si), 1.0 to 2.0% of manganese (Mn), 0.005 to 0.1% of aluminum (Al), 0.010% or less of phosphorus (P), 0.0015% or less of sulfur (S), 0.001 to 0.03% of niobium (Nb), 0.001 to 0.03% of vanadium (V), 0.01 to 0.15% of molybdenum (Mo), 0.01 to 0.50% of copper (Cu), 0.05 to 0.50% of nickel (Ni), and a remainder of iron (Fe) and unavoidable impurities, reducing the primarily heated slab in a length direction and a width direction, selectively secondarily heating the slab reduced in the length direction and the width direction to be reduced in the thickness direction, tertiarily heating the slab reduced in the thickness direction to be hot rolled and air-cooling the hot-rolled slab to provide a steel material, and quaternarily heating the steel material to be heat-treated and air-cooling the heat-treated steel material to room temperature. A maximum size of a pore in the slab reduced in the thickness direction is 1 μm or less.

The steel material may have a thickness of 100 to 300 mm.

A temperature of the primary heating may be 1150 to 1250° C.

The slab may be reduced in a length direction at a reduction rate of 10 to 20% at a temperature within a range of 1100 to 1200° C.

The slab may be reduced in a width direction at a reduction rate of 10 to 30% at a temperature within a range of 1050 to 1150° C.

The slab may be secondarily heated to a temperature within a range of 1000 to 1140° C. when a temperature of the slab reduced in the length direction and the width direction is 950° C. or less.

The slab may be reduced in a thickness direction at a reduction rate of 30% or more.

The slab may be tertiarily heated to a temperature within a range of 1000 to 1140° C. to be hot-rolled at a reduction rate of 30 to 75% at a temperature within a range of 1000 to 1140° C.

The steel material may be quaternarily heated to a temperature within a range of 850 to 950° C. and then maintained for 15 to 50 minutes to be heat-treated.

An austenite structure in a center portion of the hot-rolled steel material may have an average grain size of 70 μm or less, and an austenite structure in a center portion of the quaternarily heated and heat-treated steel material may have an average grain size of 30 μm or less.

The slab may further include, by wt %: one or two or more of 0.001 to 0.03% of titanium (Ti), 0.01 to 0.20% of chromium (Cr), and 0.0005 to 0.004% of calcium (Ca).

Advantageous Effects

According to the present disclosure, a steel material having a thickness of 100 to 300 mm, especially appropriate for a pressure container, and effectively securing hydrogen-induced cracking resistance and low-temperature toughness and a method for preparing the same may be provided.

BEST MODE FOR INVENTION

The present disclosure relates to a steel material having excellent hydrogen-induced cracking resistance and a method for preparing the same. Examples of the present disclosure may be modified in various forms, and the scope of the present disclosure should not be construed as being limited to these examples set forth herein. The examples are provided to explain the present disclosure so that the present disclosure will be thorough and complete, and will fully convey the scope of the present disclosure to those skilled in the art.

Hereinafter, a steel composition of the present disclosure will be described in more detail. Hereinafter, weight percentage (wt %) is simply described as percentage (%) unless otherwise specified.

A steel material having excellent hydrogen-inducted cracking resistance according to an aspect of the present disclosure may include, by weight percentage (wt %), 0.10 to 0.25% of carbon (C), 0.05 to 0.50% of silicon (Si), 1.0 to 2.0% of manganese (Mn), 0.005 to 0.1% of aluminum (Al), 0.010% or less of phosphorus (P), 0.0015% or less of sulfur (S), 0.001 to 0.03% of niobium (Nb), 0.001 to 0.03% of vanadium (V), 0.01 to 0.15% of molybdenum (Mo), 0.01 to 0.50% of copper (Cu), 0.05 to 0.50% of nickel (Ni), and a remainder of iron (Fe) and unavoidable impurities.

C: 0.10 to 0.25%

Carbon (C) is the most important element for securing basic strength, and thus, needs to be included in steel within an appropriate range. Therefore, in the present disclosure, a lower limit of the content of C is limited to 0.10% to obtain such an addition effect. However, when C is excessively added, center segregation may be increased, and a mixed structure of ferrite and bainite and an MA structure may be formed during air cooling to result in excessive strength or hardness. Accordingly, in the present disclosure, an upper limit of the content of C may be limited to 0.25%. Therefore, the content of C may be limited to a range of, in detail, 0.10 to 0.25%. The content of C may be adjusted to be within a range of, in more detail, 0.10 to 0.20% and, in even more detail, 0.10 to 0.15%.

Si: 0.05 to 0.50%

Silicon (Si) is a substitutional element improving strength of steel through solid solution strengthening and has a strong deoxidizing effect, and thus, is necessarily required to manufacture clean steel. To this end, a lower limit of the content of Si may be 0.05%. However, when the content of Si is excessively high, an MA structure maybe formed and strength of a ferrite matrix may be excessively increased, and thus, hydrogen-inducted cracking characteristics, impact toughness, and the like may be deteriorated. Accordingly, in the present disclosure, an upper limit of the content of Si may be limited to 0.50%. Therefore, the content of Si may be adjusted to be within a range of 0.05 to 0.50%. The content of Si may be adjusted to be within a range of, in detail, 0.05 to 0.40% and, in more detail, 0.20 to 0.35%.

Mn: 1.0 to 2.0%

Manganese (Mn) is an element improving strength through solid solution strengthening and improving hardenability to form a low-temperature transformation phase. In addition, since Mn may improve hardenability to form a low-temperature transformation phase even at a low cooling rate, Mn is an important element for securing a low-temperature bainite phase during air cooling after a final heat treatment. To this end, in the present disclosure, a lower limit of the content of Mn may be limited to 1.0%. However, when the content of Mn is excessively high, center segregation may be increased and a fraction of an MnS inclusion formed by binding with S may be increased, and thus, hydrogen-induced cracking resistance characteristics may be deteriorated. Therefore, in the present disclosure, the content of Mn may be adjusted to be within a range of, in detail, 1.0 to 1.7% and, in more detail, 1.0 to 1.5%.

Al: 0.005 to 0.1%

Aluminum (Al), in addition to Si, functions as strong deoxidizer in a steelmaking process. To this end, a lower limit of Al may be limited to 0.005%. However, when the content of Al is excessively high, a large amount of coarse oxidative inclusion ($Al_2O_3$) is formed as a result of deoxidation. Such an oxidative inclusion may not be completely removed even by a refinement process and may remain in an end product to deteriorate hydrogen-induced cracking resistance. Accordingly, in the present disclosure, an upper limit of the content of Al may be limited to 0.1%. Therefore, the content of Al may be adjusted to be within a range of 0.005 to 0.1%. The content of Al may be adjusted to be within a range of, in detail, 0.005 to 0.05% and, in more detail, 0.035 to 0.05%.

P: 0.010% or Less

Phosphorous (P) is an element unavoidably included in a steelmaking process and causes brittleness in a grain boundary. Therefore, in the present disclosure, the content of P may be limited to 0.010% or less to improve brittle cracking propagation resistance.

S: 0.0015% or Less

Sulfur (S) is also an element unavoidably included in the steelmaking process and causes brittleness by forming coarse inclusions. Therefore, in the present disclosure, the content of S may be limited to 0.0015% or less to improve the brittle cracking propagation resistance.

Nb: 0.001 to 0.03%

Niobium (Nb) is an element precipitated in the form of NbC or NbCN to improve strength of a base material. In addition, Nb solid-solubilized during reheating at a high temperature may be significantly finely precipitated in the form of NbC during rolling. The finely precipitated NbC may suppress recrystallization of austenite to refine a structure. Therefore, in the present disclosure, a lower limit of the content of Nb maybe limited to 0.001% to obtain such an effect. However, when the content of Nb is excessively high, undissolved Nb may be generated in the form of TiNb(C,N) to deteriorate impact toughness and hydrogen-induced cracking resistance. Accordingly, in the present disclosure, an upper limit of the content of Nb may be limited to 0.03%. Therefore, the content of Nb may be adjusted to be within a range of 0.001 to 0.03%. The content of Nb may be adjusted to be within a range of, in detail, 0.005 to 0.02% and, in more detail, 0.007 to 0.015%.

V: 0.001 to 0.03%

Vanadium (V) is almost completely re-solid solubilized during a reheating process to have a poor strength increasing effect caused by precipitation or solid solution during a subsequent rolling process or the like. However, V may be precipitated as a significantly fine carbonitride in a subsequent heat treatment improve strength. After a final heat treatment, V may improve hardenability of austenite to increase a fraction of air-cooled bainite. To this end, the content of V may be limited to 0.001% or more. However, when the content of V is excessively high, it is uneconomical strength and hardness of a welding zone may be excessively increased to cause surface cracking, or the like. Therefore, in the present disclosure, the content of V may be adjusted to be within a range of 0.001 to 0.03%. The content of V may be adjusted to be within a range of, in detail, 0.005 to 0.02% and, in more detail, 0.007 to 0.015%.

Mo: 0.01 to 0.15%

Molybdenum (Mo) is an element effective in preventing strength from decreasing during a heat treatment process after tempering or welding and is an element effectively preventing deterioration in toughness resulting from impurities, such as P or the like, segregated in a grain boundary. In addition, Mo is a solid-solution strengthening element in ferrite and is an element increasing strength of a matrix phase. Accordingly, in the present disclosure, a lower limit of the content of M may be limited to 0.01% to obtain such an effect. However, since Mo is an expensive element, excessive addition of Mo is uneconomical. Therefore, an upper limit of the content of Mo may be limited to 0.15%. Therefore, in the present disclosure, the content of Mo may be adjusted to be within a range of 0.01 to 0.15%.

Cu: 0.01 to 0.50%

Cu is an element able to significantly improve strength of a matrix phase by solid solution strengthening in ferrite, and is an element effectively suppressing corrosion of the base material in a wet hydrogen sulfide atmosphere. Accordingly, in the present disclosure, a lower limit of the content of Cu maybe limited to 0.01% to obtain such an effect. However, when the content of Cu is excessively high, it is uneconomical and there is high possibility star cracking occurs on a surface of a steel sheet. Therefore, an upper limit of the content of Cu maybe limited to 0.50%. Therefore, in the present disclosure, the content of Cu may be adjusted to be within a range of 0.01 to 0.50%.

Ni: 0.05 to 0.50%

Nickel (Ni) is an important element for increasing a stacking fault at a low temperature to facilitate cross slip at a dislocation, and thus, improving impact toughness and hardenability to increase hardness. Accordingly, a lower end of the content of Ni may be limited to 0.05%. However, when the content of nickel (Ni) is excessively high, it is uneconomical and hardenability may be excessively increased. Accordingly, in the preset disclosure, the content of Ni may be adjusted to be within a range of 0.05 to 0.50%. The content of Ni may be adjusted to be within a range of, in detail, 0.10 to 0.40% and, in more detail, 0.10 to 0.30%.

The steel material having excellent hydrogen-inducted cracking resistance according to one aspect of the present disclosure may further include one or two or more of, by weight percentage (wt %), 0.001 to 0.03% of titanium (Ti), 0.01 to 0.20% of chromium (Cr), and 0.0005 to 0.004% of calcium (Ca).

Ti: 0.001 to 0.03%

Titanium (Ti) is an element precipitated as TiN during a reheating process to suppress growth of grains of a base material and a heat-affected zone to significantly improve low-temperature toughness. According, in the present disclosure, a lower limit of the content of Ti may be limited to 0.001%. However, when the content of Ti is excessively high, a continuous casting nozzle may be clogged or low-temperature toughness may be decreased by central crystallization. In addition, when Ti binds to nitrogen (N), a coarse TiN precipitate may be formed in a central portion to act as an initiation point of hydrogen-inducted cracking. Accordingly, in the present disclosure, the content of Ti may be adjusted to be within a range of 0.001 to 0.03%. The content of Ti may be adjusted to be within a range of, in detail, 0.011 to 0.025% and, in more detail, 0.013 to 0.018%.

Cr: 0.01 to 0.20%

Although chromium (Cr) is slightly effective in increasing yield strength and tensile strength by solid solution, Cr slows down decomposition of cementite during a heat treatment after tempering or welding to effectively prevent a decrease in strength. Accordingly, in the present disclosure, a lower limit of the content of Cr may be limited to 0.01%. However, when the content of Cr is excessively high, it is uneconomical and a size and a fraction of Cr-rich carbide such as $M_{23}C_6$ may be increased to significantly reduce impact toughness. Accordingly, in the present disclosure, an upper limit of Cr may be limited to 0.20%. Therefore, the content of Cr may be adjusted to be within a range of 0.01 to 0.20%.

Ca: 0.0005 to 0.004%

When calcium (Ca) is added after deoxidation is performed by Al, Ca may bind to sulfur (S), forming an MnS inclusion, to suppress formation of MnS and may form spherical CaS to suppress cracking occurrence caused by hydrogen-induced cracking. Accordingly, in the present disclosure, a lower limit of Ca may be limited to 0.0005% form sufficient CaS. However, when the content of Ca is excessively high, Ca remaining after forming Cas binds to oxygen (O) to form a coarse oxidative inclusion. Such a coarse oxidative inclusion may be elongated and fractured during rolling to promote hydrogen-inducted cracking. Accordingly, in the present disclosure, an upper limit of the content of Ca may be limited to 0.004%. Therefore, the content of Ca may be adjusted to be within a range of 0.0005 to 0.004%.

However, in a steel manufacturing process according to the present disclosure, impurities, not intended, may be unavoidably incorporated, so that such impurities cannot be excluded. All of these impurities are not specifically described in this specification, as they are commonly known to those skilled in the art of steelmaking. Moreover, addition of other elements, other than the above-described composition, is not excluded.

Hereinafter, pores of the present disclosure will be described in more detail.

A maximum size of a pore, formed in a steel material having excellent hydrogen-induced cracking resistance according to an embodiment, may be 1 μm or less.

A pore formed in a steel material may act as an initiation point of cracking. To secure hydrogen-induced cracking resistance, a size and a fraction of a pore should be managed to an appropriate level. In particular, in the case of thick steel plate such as the steel material according to the present disclosure, occurrence of hydrogen-induced cracking is significantly affected by whether there is a coarse pore among individual pores, rather than a fraction of pores formed in the steel material. Accordingly, the present disclosure is intended to secure hydrogen-induced cracking resistance by limiting a size of a pore formed in the steel material to a certain level or less. Therefore, a maximum size of the pore formed in the steel material according to the present disclosure may be 1 μm or less.

In addition, since a steel material having excellent hydrogen-induced cracking resistance according to an embodiment is an ultra-thick hot-rolled steel sheet having a thickness of 100 to 300 mm, hot rolling has a slight effect on a size of a pore formed in an end steel material. For example, since the size of the pore formed in the end steel material is dependent on a size of a pore formed in a slab provided to hot rolling, a pore formed in the slab by forging may be significantly reduced to significantly reduce the size of the pore formed in the end steel material.

Hereinafter, a microstructure according to the present disclosure will be described in more detail.

The steel material having excellent hydrogen-induced cracking resistance according to an embodiment may include a ferrite structure in an amount of 70% or more and a retained pearlite structure.

A steel material, provided through a normalizing heat treatment, may have a mixed structure of a ferrite structure and a pearlite structure, and a steel material having these structures may have strength determined by a fraction of the pearlite structure. When the pearlite structure is greater than 30 area %, the strength of the steel material may be increased while impact toughness thereof is decreased. Accordingly, in the present disclosure, an area ratio of the ferrite structure maybe limited to 70% or more to secure Charpy impact absorption energy of 250 J secure at tensile strength of 500 MPa or more at a temperature of −46° C.

Therefore, the steel material having excellent hydrogen-induced cracking resistance according to an embodiment is a thick steel plate having a thickness of 100 to 300 mm, and may satisfy a tensile strength of 500 MPa or more, Charpy impact absorption energy of 250 J or more at a temperature of −46° C., and a hydrogen-induced cracking length ratio of 5% or less. As a result, the steel material having excellent hydrogen-induced cracking resistance according to an embodiment may secure a thickness and physical properties appropriate for a pressure vessel.

Hereinafter, a manufacturing process of the present disclosure will be described in more detail.

A method for manufacturing a steel material having excellent hydrogen-induced cracking resistance according to an embodiment may include primarily heating a slab provided with the above-described composition, reducing the primarily heated slab in a length direction and a width direction, selectively secondarily heating the slab reduced in the length direction and the width direction to be reduced in the thickness direction, tertiarily heating the slab reduced in the thickness direction to be hot rolled and air-cooling the hot-rolled slab to room temperature to provide a steel material, and quaternarily heating the steel material to be heat-treated and air-cooling the heat-treated steel material.

Since a composition of the slab according to the present disclosure and the contents thereof correspond to the composition of the above-described steel material and the contents thereof, the descriptions of the composition of the slab according to the present disclosure and the contents thereof will be replaced with the descriptions of the composition of the above-described steel material and the contents thereof.

Primary Heating of Slab

The slab provided with the above-described composition maybe primarily heated to a temperature within a range of 1150 to 1250° C. To effectively compress a pore in the slab when the slab is reduced in a width direction, a primary heating temperature maybe 1150° C. or higher. However, when the primary heating temperature is excessively high, an excessive oxide scale is formed on a surface of the slab and manufacturing cost competitiveness in furnace management is lowered. Therefore, the primary heating temperature of the slab may be limited to 1250° C. or higher.

After the primary heating of the slab, a forging process may be performed to reduce the slab in a width direction and a thickness direction. Hereinafter, the reduction in the length direction, reduction in the width direction, and reduction in a thickness direction will be described in more detail.

Upsetting and Cogging

Upsetting (reduction in length direction) and cogging (reduction in width direction) may be sequentially performed on the primarily heated slab. Although the order of performing the upsetting and the cogging is particularly limited, after performing upsetting, the cogging may be preferably performed in terms of a reduction in porosity of the slab.

The upsetting may be performed at a reduction rate of 10 to 20% at a temperature within a range of 1100 to 1200° C. The reduction rate of the upsetting may be 10% or more to secure a porosity reduction effect depending on the cogging. However, when the reduction rate of the cogging is excessive, the slab maybe buckled. Therefore, the reduction rate of the upsetting maybe 20% or less. An upsetting temperature has a temperature range considering a cogging temperature. An upsetting temperature for securing a sufficient reduction rate during the cogging may be 1100° C. or higher. In the present disclosure, an upper limit of the upsetting temperature is not necessarily limited, but an upper limit of the upsetting temperature considering the primary heating temperature may be 1200° C.

A size of the pore in the slab is reduced by the cogging, and thus, the porosity of the slab may be reduced. Therefore, the reduction rate of the cogging for achieving such an effect may be 10% or more. However, when the reduction rate of the cogging is excessive, forging cracking may occur in the slab. Accordingly, in the present disclosure, an upper limit of the reduction rate of the cogging may be limited to 30%. To prevent reduction force from being decreased by deformation resistance of the slab, the cogging may be performed at a temperature of 1050° C. or higher. In the present disclosure, an upper limit of the cogging temperature is not necessarily limited. However, the upper limit of the cogging temperature considering of the primary heating temperature and the upsetting temperature may be 1150° C.

Selective Secondary Heating and Reduction in Thickness Direction of Slab

The slab, on which the upsetting and the cogging are completed, maybe reduced in a thickness direction. Only when a temperature of the slab provided for the reduction in the thickness direction is a certain level or less, secondary heating may be performed on the slab. For example, the secondary heating may be selectively performed, and the temperature of the slab, a basis for whether or not to perform the secondary heating, may be 950° C. This is because when the temperature of the slab provided for the reduction the thickness direction is 950° C. or less, an appropriate reduction rate may not be secured due to deformation resistance of the slab and there is high possibility that forging cracking occurs. Therefore, when the temperature of the slab provided for the reduction in the thickness direction is 950° C. or less, the slab may be secondarily heated to a temperature within a range of 1000 to 1140° C. When the temperature of the slab provided for the reduction in the thickness direction is higher than 950° C., the secondary heating may be omitted and the reduction in the thickness may be performed.

Since the size of the pore in the slab is finally determined by the amount of the reduction in the thickness direction, the amount of reduction in the thickness direction for effectively refine a size of a pore may be 30% or more. A maximum size of the pore in the slab, on which the reduction in the thickness direction is completed, may be 1 μm or less, and a fraction occupied by pores based on a cross section of the slab, on which the reduction in the thickness direction is completed, may be 3 area % or less.

Tertiary Heating and Hot Rolling of Slab

The slab, on which the reduction in an length direction, the reduction in the width direction, and the reduction in the thickness are completed, may be tertiarily heated to a temperature within a range of 1000 to 1140° C. and then hot-rolled at a temperature within a range of 1000 to 1140° C. to provide a hot-rolled steel sheet. The hot rolling may be performed at a temperature of 1000° C. or higher to obtain a grain refinement effect resulting from precipitation strengthening by NbC and solid-solution strengthening of Nb. This is because when a hot-rolling temperature is less than 1000° C., the amount of solid solution of Nb is reduced to 70% or less to prevent the precipitation strengthening by NbC and the solid-solution strengthening of Nb from being sufficiently exhibited. However, when the hot-rolling temperature is excessively high, an oxide scale may be excessively formed, and there may be a possibility that a high-temperature brittle damage occurs. Accordingly, in the present disclosure, an upper limit of the hot-rolling temperature maybe limited to 1140° C. A finishing rolling end temperature of the hot-rolled steel sheet may be Ar3+20° C. and, after the hot rolling is finished, the hot-rolled steel sheet may be cooled to room temperature by air cooling.

A reduction rate of the hot rolling may be determined by a thickness of a final steel material and may be, in detail, 30 to 75%. In addition, when an average grain size of an austenite structure in the center of the steel material immediately after completion of the hot rolling is excessively coarse, an austenite grain size equal to or less than a certain level even after a normalizing heat treatment may not be secured. Accordingly, low-temperature impact toughness of the final steel maybe reduced. Therefore, in the present disclosure, the average grain size of the austenite structure in the center of the steel material immediately after the completion of the hot rolling may be limited to 70 μm or less.

In addition, since the steel material according to the present disclosure is a thick steel plate having a thickness of 100 to 300 mm, a size of a pore may not be significantly affected by hot rolling. Therefore, the maximum size of the pore in the steel material after the completion of the hot rolling may also be 1 μm or less.

Quaternary Heating and Air-Cooling of Steel Material

The hot-rolled steel sheet cooled to room temperature is quaternarily heated to a temperature within a range of 850 to 950° C., and then maintained for 15 to 50 minutes to be normalizing heat-treated. A lower limit of a quaternary heating temperature maybe limited to 850° C. to sufficiently homogenize an austenite structure, and an upper limit of the quaternary heating temperature may be limited to 950° C. to prevent NbC and VC precipitates from being coarsened. A maintaining time of the quaternary heating may be limited to 15 minutes or more homogenize the austenite structure, and an upper limit of the maintaining time of the quaternary heating may be limited to 50 minutes to prevent a precipitate and a grain from being coarsened.

The average grain size of the austenite structure in the center of the hot-rolled steel sheet immediately after the completion of the heat treatment by the quaternary heating is refined to a level of 30 μm, and thus, strength and low-temperature toughness of the final steel material may be effectively secured. In particular, when the grain size immediately after the heat treatment by the quaternary heating is greater than 30 μm, DBTT required for an end product is increased, so that Charpy impact energy of 250 J at a temperature of −46° C. may not be satisfied. Therefore, the average grain size of the austenitic structure immediately after the heat treatment by the quaternary heating should be secured to a level of 30 μm or less.

BEST MODE FOR INVENTION

Hereinafter, embodiments of the present disclosure will be described more specifically through examples. However, the examples are for clearly explaining the embodiments of the present disclosure and are not intended to limit the scope of the present invention.

EXAMPLE

A hot-rolled was manufactured under conditions of Table 2 using a slab provided with a composition of Table 1. The slab was heated at a temperature of 1200° C., and the amount of reduction in a length direction was 15%. In conditions J and M, a temperature of the slab was less than a temperature of the reduction in the thickness direction and the reduction in the thickness direction was performed without performing secondary heating.

TABLE 1

| Steel Type | Alloy Composition (wt %) | | | | | | | | | | | | | |
|---|---|---|---|---|---|---|---|---|---|---|---|---|---|---|
| | C | Si | Mn | Al | P* | S* | Nb | V | Ti | Cr | Mo | Cu | Ni | Ca* |
| 1 | 0.18 | 0.35 | 1.13 | 0.035 | 80 | 8 | 0.007 | 0.001 | 0.011 | 0.01 | 0.05 | 0.05 | 0.1 | 35 |
| 2 | 0.17 | 0.31 | 1.12 | 0.031 | 70 | 6 | 0.01 | 0.001 | 0.001 | 0.01 | 0.05 | 0.01 | 0.25 | 27 |
| 3 | 0.18 | 0.32 | 1.21 | 0.032 | 51 | 5 | 0.011 | 0.001 | 0.01 | 0.02 | 0.07 | 0.01 | 0.15 | 21 |
| 4 | 0.19 | 0.35 | 1.09 | 0.033 | 83 | 5 | 0.001 | 0.007 | 0.012 | 0.05 | 0.08 | 0.03 | 0.07 | 23 |
| 5 | 0.17 | 0.36 | 1.1 | 0.035 | 75 | 5 | 0.001 | 0.012 | 0.005 | 0.01 | 0.08 | 0.2 | 0.12 | 16 |
| 6 | 0.31 | 0.35 | 1.15 | 0.031 | 81 | 9 | 0.007 | 0.007 | 0.013 | 0.1 | 0.12 | 0.35 | 0.35 | 22 |
| 7 | 0.16 | 0.33 | 2.45 | 0.032 | 80 | 6 | 0.015 | 0.015 | 0.01 | 0.01 | 0.06 | 0.05 | 0.15 | 22 |
| 8 | 0.18 | 0.37 | 1.12 | 0.031 | 71 | 31 | 0.001 | 0.013 | 0.011 | 0.02 | 0.07 | 0.1 | 0.13 | 32 |
| 9 | 0.15 | 0.35 | 1.10 | 0.035 | 83 | 8 | 0.0001 | 0.0002 | 0.007 | 0.01 | 0.06 | 0.11 | 0.19 | 34 |
| 10 | 0.18 | 0.31 | 1.15 | 0.031 | 70 | 8 | 0.006 | 0.001 | 0.001 | 0.01 | 0.05 | 0.01 | 0.1 | 30 |
| 11 | 0.17 | 0.33 | 1.16 | 0.035 | 71 | 9 | 0.001 | 0.001 | 0.013 | 0.07 | 0.06 | 0.09 | 0.12 | 25 |
| 12 | 0.16 | 0.3 | 1.15 | 0.035 | 73 | 10 | 0.005 | 0.007 | 0.001 | 0.08 | 0.05 | 0.01 | 0.1 | 31 |
| 13 | 0.18 | 0.35 | 1.1 | 0.031 | 72 | 8 | 0.001 | 0.012 | 0.012 | 0.05 | 0.06 | 0.05 | 0.13 | 27 |
| 14 | 0.19 | 0.36 | 1.23 | 0.036 | 81 | 7 | 0.004 | 0.019 | 0.001 | 0.08 | 0.06 | 0.05 | 0.15 | 31 |
| 15 | 0.17 | 0.38 | 1.31 | 0.031 | 62 | 6 | 0.001 | 0.015 | 0.013 | 0.01 | 0.06 | 0.01 | 0.17 | 29 |

(P*, S*, and Ca* indicate ppm by weight)

TABLE 2

| Steel Type | Condition | Forging | | | | | Hot Rolling | | Heat Treatment | |
|---|---|---|---|---|---|---|---|---|---|---|
| | | Temperature of Reduction in Length Direction (° C.) | Temperature of Reduction in Width Direction (° C.) | Amount of Reduction in Width Direction (%) | Temperature of Reduction in Thickness Direction (%) | Amount of Reduction in Thickness Direction (%) | Heating Temperature (° C.) | Amount of Reduction (%) | Tempera-ture (° C.) | Time (min) |
| 1 | A | 1,152 | 1,053 | 15 | 995 | 35 | 1121 | 34 | 910 | 17 |
| 2 | B | 1,158 | 1,062 | 17 | 1001 | 41 | 1130 | 55 | 899 | 18 |
| 3 | C | 1,170 | 1,075 | 29 | 1010 | 39 | 1111 | 71 | 863 | 17 |
| 4 | D | 1,183 | 1,051 | 21 | 1008 | 43 | 1102 | 39 | 880 | 20 |
| 5 | E | 1,222 | 1,100 | 16 | 1031 | 51 | 1059 | 51 | 913 | 21 |
| 6 | F | 1,212 | 1,152 | 25 | 1110 | 50 | 1003 | 50 | 920 | 22 |
| 7 | G | 1,159 | 1,153 | 24 | 1121 | 43 | 1135 | 49 | 915 | 20 |
| 8 | H | 1,233 | 1,156 | 21 | 1130 | 45 | 1126 | 41 | 911 | 37 |
| 9 | I | 1,251 | 1,137 | 28 | 1110 | 51 | 1131 | 48 | 900 | 41 |
| 10 | J | 981 | 935 | 7 | Unable to Operate | Unable to Operate | 1141 | 42 | 910 | 20 |
| 11 | K | 1170 | 1131 | 9 | 1100 | 39 | 1131 | 51 | 890 | 18 |
| 12 | L | 1198 | 1051 | 28 | 1100 | 3 | 1131 | 51 | 887 | 24 |
| 13 | M | 1131 | 1054 | 27 | 853 | 4 | 1150 | 42 | 884 | 30 |
| 14 | N | 1184 | 1053 | 26 | 1117 | 39 | 940 | 31 | 890 | 25 |
| 15 | O | 1160 | 1055 | 29 | 1003 | 45 | 1135 | 59 | 980 | 107 |

The average pore size, the austenite grain size, the hydrogen-induced cracking length ratio (CLR), the Charpy impact absorption energy and tensile strength at −46° C. of the steel materials prepared by the conditions of Tables 1 and 2 were measured, and the results are shown in Table 3 below.

TABLE 3

| Classification | Condition | Pearlite Area Fraction | Maximum Pore Size (μm): After Reduction in Width Direction | Maximum Pore Size (μm): After Reduction in Thickness Direction | Austenite Grain Size (μm): After Forging | Austenite Grain Size (μm): After Rolling | Austenite Grain Size (μm): After Normalizing | HIC CLR (%) | Charpy Impact Absorption Energy (J) at −46° C. | Tensile Strength (MPa) | Remark |
|---|---|---|---|---|---|---|---|---|---|---|---|
| 1 | A | 22 | 12 | 0.1 | 163 | 63 | 27 | 0 | 250 | 500 | IE1 |
| 2 | B | 21 | 11 | 0.3 | 166 | 66 | 29 | 0 | 262 | 505 | IE2 |
| 3 | C | 21 | 10 | 0.2 | 159 | 58 | 25 | 0 | 254 | 509 | IE3 |
| 4 | D | 19 | 12 | 0.1 | 162 | 59 | 23 | 0 | 269 | 510 | IE4 |
| 5 | E | 19 | 15 | 0.5 | 167 | 64 | 22 | 0 | 277 | 511 | IE5 |
| 6 | F | 35 | 15 | 0.1 | 170 | 50 | 23 | 32 | 29 | 642 | CE1 |
| 7 | G | 23 | 17 | 0.2 | 182 | 59 | 24 | 22 | 152 | 511 | CE2 |
| 8 | H | 22 | 20 | 0.1 | 181 | 61 | 22 | 39 | 132 | 515 | CE3 |

TABLE 3-continued

| Classification | Condition | Pearlite Area Fraction | Maximum Pore Size (μm) After Reduction in Width Direction | Maximum Pore Size (μm) After Reduction in Thickness Direction | Austenite Grain Size (μm) After Forging | Austenite Grain Size (μm) After Rolling | Austenite Grain Size (μm) After Normalizing | HIC CLR (%) | Charpy Impact Absorption Energy (J) at −46° C. | Tensile Strength (MPa) | Remark |
|---|---|---|---|---|---|---|---|---|---|---|---|
| 9 | I | 20 | 11 | 0.5 | 180 | 66 | 25 | 0 | 255 | 431 | CE4 |
| 10 | J | 17 | 59 | 30 | 180 | 59 | 24 | 33 | 215 | 511 | CE5 |
| 11 | K | 18 | 27 | 16 | 183 | 55 | 23 | 44 | 250 | 512 | CE6 |
| 12 | L | 20 | 22 | 15 | 191 | 50 | 26 | 39 | 251 | 532 | CE7 |
| 13 | M | 21 | 27 | 18 | 185 | 50 | 24 | 34 | 262 | 522 | CE8 |
| 14 | N | 18 | 21 | 0.8 | 188 | 71 | 45 | 0 | 15 | 450 | CE9 |
| 15 | O | 19 | 25 | 1.5 | 184 | 56 | 27 | 0 | 20 | 488 | CE10 |

IE: Inventive Example/CE: Comparative Example

Inventive Examples 1 to 5 satisfied composition contents and manufacturing conditions of the present disclosure. It is confirmed that Inventive Examples 1 to 5 satisfied 1 μm or less of a maximum size of a pore after the reduction in the thickness direction, 500 MPa or more of tensile strength, 250 J or more of Charpy impact absorption energy at a temperature of −46° C., and a hydrogen-induced cracking length ratio.

In Comparative Example 1, a content range of C exceeded the range of the present disclosure. It is confirmed that the tensile strength after normalizing had a significantly high level of 642 MPa depending on an excessive fraction of pearlite. It is also confirmed that centerline segregation was increased due to a high content of carbon, and thus, hydrogen-induced cracking characteristics and a low-temperature impact toughness values were slightly poor.

In Comparative Examples 2 and 3, content ranges of Mn and S exceeded the range of the present disclosure. Porosity after a forging process satisfied the range of the present disclosure, but hydrogen-induced cracking length ratios (CLR) of Comparative Examples 2 and 3 were approximately 22% and 39%, respectively. Accordingly, it is confirmed that a MnS inclusion was formed in the center of a steel sheet to significantly deteriorate hydrogen-induced cracking characteristics.

In Comparative Example 4, content ranges of Nb and V were less than the range of the present disclosure. It is confirmed that although porosity after a forging process was secured to a significantly low level, an ultrafine precipitates such as NbC or VC was not formed in the quaternary heating process, and thus, tensile strength had a significantly low level of 431 MPa.

In Comparative Example 5, a temperature of reduction in a length direction and a temperature of reduction in a width direction during a forging process were less than the range of the present disclosure, and thus, the amount of the reduction in the thickness direction was insufficiently secured. A size of a pore after the reduction in the width direction and the reduction in the length direction had a level of 30 μm or more, and a hydrogen-induced cracking length ratio (CLR) had a level of 33%. Accordingly, it is confirmed the hydrogen-induced cracking characteristics were also poor.

In Comparative Example 6, the amount of reduction in a width direction during a forging process was less than the range of the present disclosure. Accordingly, it is confirmed that a width of a slab for reduction in a thickness direction was not secured, and thus, a coarse pore in the slab was not compressed. It is also confirmed that a hydrogen-induced cracking length ratio (CLR) of Comparative Example 6 had a level of 44% and hydrogen-induced cracking characteristics were significantly poor.

In Comparative Example 7, the amount of reduction in a thickness direction was less than the range of the present disclosure. Accordingly, it is confirmed that a coarse pore in a slab was not compressed. Therefore, it is confirmed that hydrogen-induced cracking length ratio (CLR) of Comparative Example 7 has a level of 39%, and hydrogen-induced cracking characteristics were significantly poor.

In Comparative Example 8, the amount of reduction in a thickness direction and a temperature of the reduction in the thickness reduction were less than the range of the present disclosure. Accordingly, it is confirmed that a coarse pore in a slabs was not compressed. Therefore, it is confirmed that a hydrogen-induced cracking length ratio (CLR) of Comparative Example 8 was 34%, and hydrogen-induced cracking characteristics were significantly poor.

In Comparative Example 9, a hot rolling temperature was less than the range of the present disclosure. Accordingly, it is confirmed that solid solubility of Nb was reduced, and thus, impact toughness and tensile strength were insufficiently secured.

In Comparative Example 10, a temperature of a heat treatment performed by the quaternary heating was less than the range of the present disclosure. Accordingly, it is confirmed that impact toughness was poor.

A steel material having excellent hydrogen-inducted cracking resistance according to an embodiment and a method of manufacturing the same may provide a steel material, effectively securing hydrogen-induced cracking resistance while having a thickness appropriate for a pressure vessel, and a method for manufacturing the same.

While example embodiments have been shown and described above, the scope of the present disclosure is not limited thereto, and it will be apparent to those skilled in the art that modifications and variations could be made without departing from the scope of the present invention as defined by the appended claims.

The invention claimed is:

1. A steel material having excellent hydrogen-induced cracking resistance, the steel material comprising, by weight percentage (wt %): 0.10 to 0.25% of carbon (C), 0.05 to 0.50% of silicon (Si), 1.0 to 2.0% of manganese (Mn), 0.005 to 0.1% of aluminum (Al), 0.010% or less of phosphorus (P), 0.0015% or less of sulfur (S), 0.001 to 0.03% of niobium (Nb), 0.001 to 0.03% of vanadium (V), 0.01 to 0.15% of molybdenum (Mo), 0.01 to 0.50% of copper (Cu), 0.05 to 0.50% of nickel (Ni), and a remainder of iron (Fe) and unavoidable impurities, the steel material having a thickness of 100 to 300 mm, wherein a maximum size of a pore, formed in the steel material, is 1 μm or less, and wherein the steel material has a hydrogen-induced cracking length ratio of 5% or less.

2. The steel material of claim 1, wherein the steel material has a ferrite structure of 70 area % or more and a retained pearlite structure as a microstructure.

3. The steel material of claim 1, further comprising, by wt %: one or two or more of 0.001 to 0.03% of titanium (Ti), 0.01 to 0.20% of chromium (Cr), and 0.0005 to 0.004% of calcium (Ca).

4. The steel material of claim 1, wherein the steel material has tensile strength of 500 MPa or more and Charpy impact absorption energy of 250 J or more at a temperature of −46° C.

* * * * *